US007872189B2

(12) United States Patent
Sato

(10) Patent No.: US 7,872,189 B2
(45) Date of Patent: Jan. 18, 2011

(54) ELECTRONIC MUSICAL SOUND GENERATOR

(75) Inventor: Yasushi Sato, Hamamatsu (JP)

(73) Assignee: Kabushiki Kaisha Kawai Gakki Seisakusho, Shizuoka (JP)

( * ) Notice: Subject to any disclaimer, the term of this patent is extended or adjusted under 35 U.S.C. 154(b) by 146 days.

(21) Appl. No.: 12/394,843

(22) Filed: Feb. 27, 2009

(65) Prior Publication Data

US 2009/0223351 A1 Sep. 10, 2009

(30) Foreign Application Priority Data

Mar. 6, 2008 (JP) ..... 2008-056168

(51) Int. Cl.
*G10H 1/00* (2006.01)

(52) U.S. Cl. ..... 84/621; 84/615; 84/653; 84/645

(58) Field of Classification Search ..... 84/600–604, 84/615, 618, 621, 645, 647, 653, 656
See application file for complete search history.

(56) References Cited

U.S. PATENT DOCUMENTS 3,926,087 A * 12/1975 Griffis ..... 84/345
4,138,916 A * 2/1979 Kitagawa ..... 84/617
4,182,210 A * 1/1980 Nishimoto ..... 84/615
4,987,600 A * 1/1991 Rossum ..... 381/118
5,144,676 A * 9/1992 Rossum ..... 381/118
5,293,311 A * 3/1994 Takauji ..... 84/659
6,541,691 B2 * 4/2003 Tolonen et al. ..... 84/616
6,646,195 B1 * 11/2003 Puryear ..... 84/626
6,967,277 B2 * 11/2005 Querfurth ..... 84/645
7,030,308 B2 * 4/2006 Yagi ..... 84/484
7,038,120 B2 * 5/2006 Jung et al. ..... 84/609
7,692,090 B2 * 4/2010 Negoescu et al. ..... 84/718
2003/0066412 A1 * 4/2003 Nishitani et al. ..... 84/609
2003/0125957 A1 * 7/2003 Puterbaugh et al. ..... 704/275
2004/0031377 A1 * 2/2004 Oshiyama et al. ..... 84/602
2004/0177747 A1 * 9/2004 Tsuji et al. ..... 84/645
2004/0206228 A1 * 10/2004 Suzuki et al. ..... 84/615
2005/0103188 A1 * 5/2005 Takemura et al. ..... 84/609
2008/0134864 A1 * 6/2008 Puryear ..... 84/645
2008/0229916 A1 * 9/2008 Devalapalli et al. ..... 84/645
2009/0223351 A1 * 9/2009 Sato ..... 84/609
2010/0199832 A1 * 8/2010 Mizuhiki et al. ..... 84/604

* cited by examiner

*Primary Examiner*—David S. Warren
(74) *Attorney, Agent, or Firm*—Sughrue Mion, PLLC

(57) ABSTRACT

An electronic musical sound generator prevents a sound production sequence to be stopped from continuing to be produced even through the key is released. Even if an erroneous instruction is sent to prevent identification data from being compared, in other words, if a sound production sequence which should be stopped, continues to be produced because of failure to find the sound production sequence to be stopped, the production of the musical sound can be stopped due to the key release because a second decision block searches data in a storage block, regards a key having identification data different from the one sent as the released key, according to the sequence being produced and the key is number, and determines the sound production sequence to be stopped.

2 Claims, 7 Drawing Sheets

S100: PERFORM INITIALIZATION

S102: HAS EVENT OCCURRED?

S104: EVENT PROCESS

S106: TIME VARIABLE PROCESS

S200: KEY EVENT?
S204: PANEL EVENT?
S208: MIDI EVENT?
S202: KEY EVENT TRANSMISSION PROCESS
S206: PANEL EVENT PROCESS
S210: MIDI EVENT TRANSMISSION PROCESS
S212: SOUND SOURCE EVENT PROCESS

S302: SEND MIDI PROGRAM CHANGE NOTICE
S306: SEND MIDI CONTROL CHANGE NOTICE
S310: PERFORM AUTOMATIC MODE SETTING PROCESS
S314: PERFORM REGISTRATION SETTING PROCESS
S316: DISPLAY MENU

S400: OBTAIN ΔTi
S404: GENERATE EVENT AUTOMATICALLY
S406: IS REGISTRATION DATA BEING SENT?
S408: SEND NEXT BLOCK
S410: EXECUTE EXPRESSION PEDAL PROCESS
S412: EXECUTE PANEL SCANNING PROCESS
S414: EXECUTE KEY SCANNING PROCESS

Fig. 7

INTERNAL INTERFACE: FORMAT OF DATA SENT TO ASSIGNMENT MEMORY

| BYTE | 1 | 2 | 3 | 4 | 5 |
|---|---|---|---|---|---|
| MEANING | EVENT NO. | TRACK NO. | DATA (1) | DATA (2) | DATA (3) |

| EVENT NO | MEANING |
|---|---|
| 0x80 | KEY PRESSED: DATA (1)=KEY NUMBER, DATA (2)= INTENSITY OF PERFORMANCE, DATA (3)=ID |
| 0x81 | KEY RELEASED: DATA (1)=KEY NUMBER, DATA (2)= INTENSITY OF PERFORMANCE, DATA (3)=ID |
| : | : |

| TRACK NO | MEANING |
|---|---|
| 0x00 | Upper Orchestra I |
| 0x01 | Upper Orchestra II |
| 0x02 | Upper Special I |
| 0x03 | Upper Special II |
| 0x04 | Upper Solo I |
| 0x05 | Upper Solo II |
| 0x06 | Upper Solo III |
| 0x07 | Upper TIBIA |
| 0x08 | Lower Orchestra I |
| : | : |

Fig. 8

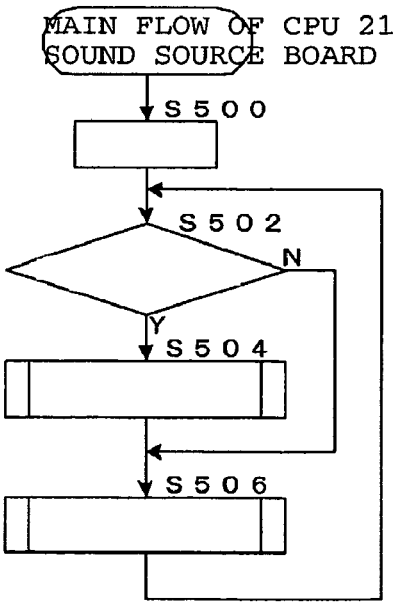

S500: PERFORM INITIALIZATION

S502: HAS MY EVENT OCCURRED?

S504: EVENT PROCESS

S506: TIME VARIABLE PROCESS

S602: NOTE PROCESS
S612: EXECUTE MIDI EXCLUSIVE PROCESS
S614: SEND COMPLETION NOTICE

S700: HAS KEY BEEN PRESSED?
S702: KEY PRESSING PROCESS
S704: KEY RELEASING PROCESS

S800: UPDATE KEY MAP
S802: EXECUTE KEY ASSIGNMENT PROCESS
S804: PRODUCE SOUND

S900: REFER TO KEY MAP
S902: ID MATCH?
S904: REGARD KEY AS KEY RELEASED
S906: REGARD KEY HAVING ANOTHER ID AS KEY RELEASED

ELECTRONIC MUSICAL SOUND GENERATOR

BACKGROUND OF THE INVENTION

1. Field of the Invention

The present invention relates to an electronic musical sound generator used for electronic musical instruments or the like.

2. Discussion of Background

Electronic organs and electronic pianos are provided with an external interface for inputting and outputting performance data as well as a performance interface for actually giving a performance, such as a keyboard, and a panel interface for making various settings for the performance. A section having these interfaces is hereinafter called first control means.

The above-described electronic musical instruments also have multiple types of sound sources corresponding to the number of sounds stored by sampling. The sound sources are provided as a plurality of sound source boards. A plurality of sound production sequences are also provided, and the number of sounds corresponding to the number of sequences can be produced according to the tone, the key number, and the intensity of performance (including what is converted from velocity data) instructed by the interface section. Usually, the sound production sequences are provided in correspondence with the tones. A section having these functions and circuits of the sound sources is hereinafter called second control means.

In the above-described electronic organs and pianos, when a key is pressed or released on the performance interface, such as a keyboard, an instruction to start or finish producing the sound is output to the second control means, and the second control means starts or finishes producing the sound in response to the instruction within the maximum number of sound production sequences according to the tone, key number and intensity of performance.

Also since the above-described electronic musical instruments are provided with the external interface as described above, performance data is input from a sequencer or another MIDI unit and transmitted to the second control means, and the second control means starts or finishes producing the sound in response to an instruction included in the data within the maximum number of sound production sequences according to the tone, key number and intensity of performance.

The total number of output sequences of the data output from the performance interface, such as a keyboard, and the data output through the external interface should be within the maximum number of sound production sequences.

When a key is pressed or released on the keyboard, the production of the corresponding sound is started or finished. If data input through the external interface at the same time indicates the same starting point of sound production at the same tone and the same musical interval, in other words, if double key pressing occurs in the same track, the production of the sound specified through the keyboard is finished according to an instruction from the first control means when it detects the release of the key.

The production of the sound specified by data input through the external interface is finished according to an instruction included data in a gatetime or the like.

If noise occurs in a transmission path connecting the first control means and the second control means, an erroneous instruction caused by the noise may be transmitted, which may result in the inability to find a sound production sequence to be stopped with the result that the sound production sequence to be stopped continues to be produced.

SUMMARY OF THE INVENTION

The present invention has been made in view of the foregoing situation. Accordingly, an object of the present invention is to provide an electronic musical sound generator that prevents a sound production sequence to be stopped from continuing to be produced even if the key is released.

To achieve the foregoing object, the present invention provides an electronic musical sound generator including first control means for sending an instruction to start or finish producing a sound; second control means for starting or finishing producing the sound in response to the instruction; data generation means for adding identification data to a tone sequence, a key number, and the intensity of performance of a sound to be produced or stopped; storage means for storing, when a key is pressed to cause sound production to be started, the identification data added by the data generation means for each sound production sequence together with the key number and the intensity of performance; first decision means for comparing the identification data added by the data generation means with the identification data stored in the storage means, for determining a sound production sequence to be stopped, according to a result of comparison, and for sending an instruction to stop the sequence, at least when the key is released among events regarded as triggers to finish the sound production; and second decision means for determining, if a sound production sequence to be stopped cannot be determined as the result of comparison, a sound production sequence to be stopped, according to the sequence being produced and the key number, and for sending an instruction to stop the sequence.

According to the above-described configuration, first, the first decision means compares the identification data added by the data generation means with the identification data stored in the storage means, determines a sound production sequence to be stopped, according to the result of comparison, and sends an instruction to stop the sequence, when the key is released. If a sound production sequence to be stopped cannot be determined as the result of comparison performed by the first decision means, the second decision means determines a sound production sequence to be stopped, according to the sequence being produced and the key number, and sends an instruction to stop the sequence.

Therefore, even if noise occurs in a transmission path connecting the first control means and the second control means with the result that an erroneous instruction caused by the noise is transmitted, the sound production sequence to be stopped is correctly stopped to prevent the sound production sequence to be stopped from being continuously produced although the sound production sequence to be stopped cannot be found.

It is preferred that the storage means be an assignment memory usually provided for each sound production sequence. The storage means, however, is not limited to the assignment memory.

An electronic musical sound generator according to the present invention provides an advantage in that, if an erroneous instruction is transmitted through a transmission path connecting the first control means and the second control means, the sound production sequence to be stopped is correctly stopped to prevent the sound production sequence to be stopped from being continuously produced although the sound production sequence to be stopped cannot be found.

BRIEF DESCRIPTION OF THE DRAWINGS

FIG. 7 shows the format and contents of data exchanged between internal interfaces;

FIG. 8 is a flowchart of a main flow procedure of the CPU in each second control unit (sound source printed circuit board);

DETAILED DESCRIPTION OF THE PREFERRED EMBODIMENTS

An embodiment of the present invention will be described below with reference to the drawings.

Figure 1:
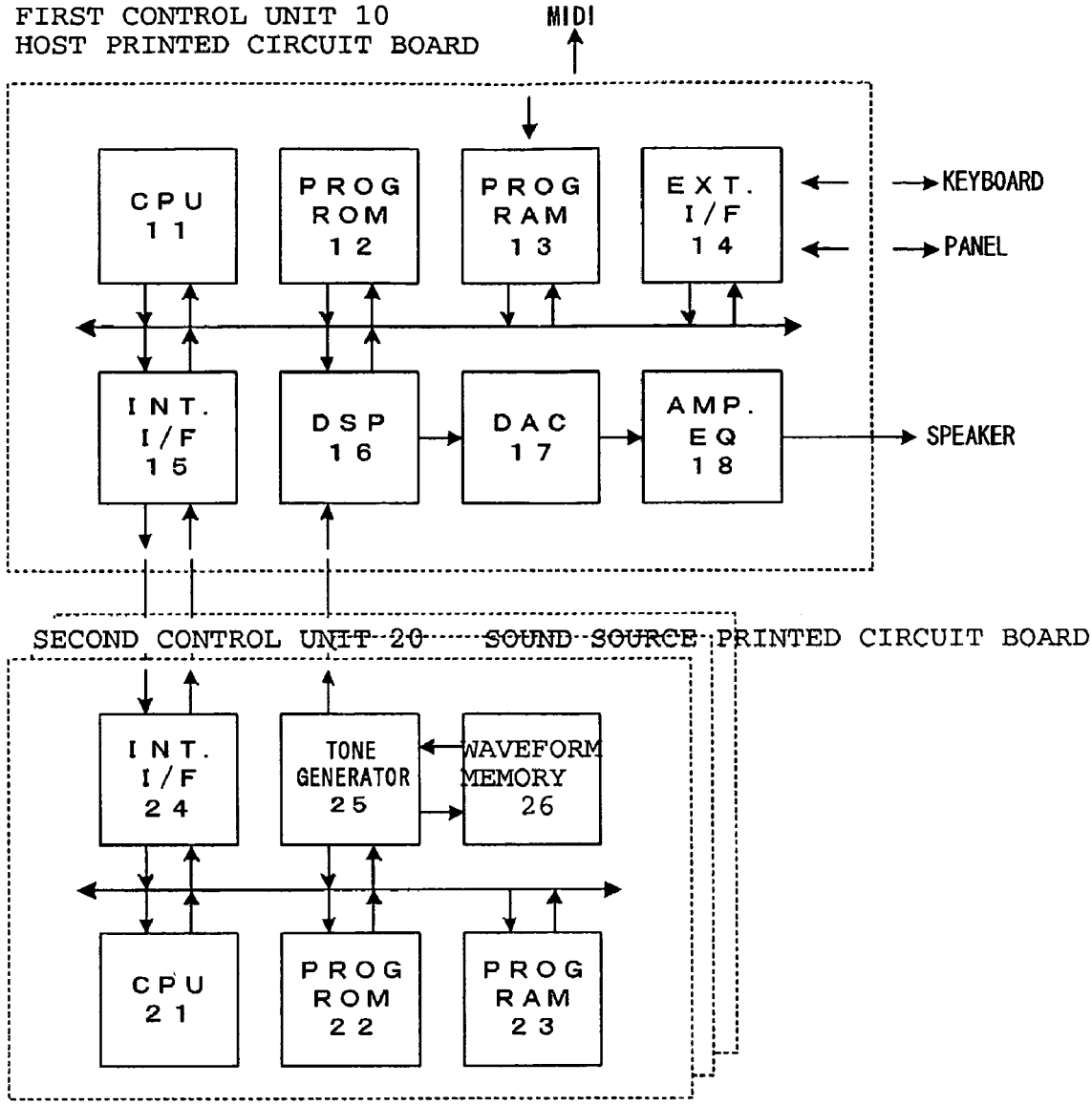
FIG. 1 is a block diagram of an internal main circuit of an electronic organ provided with an electronic musical sound generator according to an embodiment of the present invention.

FIG. 1 is a block diagram of an internal main circuit of an electronic organ provided with an electronic musical sound generator according to an embodiment of the present invention.

As shown in the figure, in the electronic organ, the electronic musical sound generator includes a first control unit 10 disposed on a host printed circuit board and a plurality of second control units 20 formed on a plurality of sound source printed circuit boards.

The first control unit 10 includes a CPU 11, a program ROM 12, a program RAM 13, an external interface 14, an internal interface 15, a digital signal processor (DSP) 16, a digital-to-analog converter (DAC) 17, and an amplifier and equalizer 18. These components are connected to each other by a bus, and control signals and data are input to and output from the components. The first control unit 10 has a function to instruct the second control unit 20 to start and finish producing a sound by transmitting transmission data in a format described later.

Each second control unit 20 includes a CPU 21, a program ROM 22, a program RAM 23, an internal interface 24, a waveform memory 26, and a sound source (tone generator, TG) 25 for producing a musical sound by reading the waveform data from the waveform memory 26. These components are connected to each other by a bus, and control signals and data are input to and output from the components. The second control unit 20 has a function to start and finish producing the sound in response to the transmission data received from the first control unit 10.

The first control unit 10 and the plurality of second control units 20 are connected to each other, and at least data in the format described later, shown in FIG. 7, is transmitted therebetween.

The CPU 11 and the CPU 21 control each component of the first control unit 10 and the second control unit 20 according to control programs stored in the program ROM 12 and the program ROM 22, respectively. The CPU 11 and the CPU 21 also execute application programs stored in the program ROM 12 and the program ROM 22, use the program RAM 13 and the program RAM 23 as work areas, if necessary, and use various types of fixed data stored in the program ROM 12 and the program ROM 22 to perform data processing, respectively.

As described above, the program ROM 12 and the program ROM 22 store the control programs for controlling the components of the first control unit 10 and the second control unit 20, and the various types of fixed data used by the CPU 11 and the CPU 21, respectively.

The program RAM 13 and the program RAM 23 store status information of the control unit 10 and the control unit 20, and are used as the work areas by the CPU 11 and the CPU 21, respectively. Various registers and flags used to control the control unit 10 and the control unit 20 are defined in the program RAM 13 and the program RAM 23, respectively. The program RAM 13 and the program RAM 23 are accessed by the CPU 11 and the CPU 21 through the buses, respectively. The program RAM 23 is also used as an assignment memory corresponding to a storage block 27, described later, provided for each sound source printed circuit board (second control unit 20) for each tone sequence.

The external interface 14 is an interface for connecting to a keyboard (no reference numeral in the figure), a foot pedal, and a display panel of the electronic organ. Performance data in response to pressing or releasing the foot pedal or a key on the keyboard, setting information specified by panel operations, and display information data are input to or output from the bus through the external interface 14. SMF data is also exchanged with a sequencer or another external MIDI unit through the external interface 14.

The internal interface 15 and the internal interface 24 connect the bus in the first control unit 10 and the bus in the second control unit 20. Data in the format shown in FIG. 7 is transmitted, or other data and an instruction are input and output, if necessary, through the internal interface 15 and the internal interface 24.

The DSP 16 applies any acoustic effect (vibrato or others) specified by the CPU 11 according to panel settings to musical sound data for each tone sequence output from the sound source (TG) 25, described later, of the second control unit 20.

The DSP 16 is connected to the DAC 17, and then, to the amplifier and equalizer 18, and further, to a speaker, which produces sounds, as shown in the figure.

The DAC 17 converts to an analog signal from the musical sound data, to which the DSP 16 has applied the acoustic effect and output in the digital format.

The amplifier and equalizer 18 includes an amplifier part which amplifies the analog acoustic signal and an equalizer part which averages the entire sound quality and clarifies the sound image by enhancing or reducing a sound signal in a particular sound range.

The sound source (TG) 25 in the second control unit 20 reads waveform data from the waveform memory 26 to produce a musical sound. The sound source (TG) 25 outputs the waveform data to the DSP 16. As described above, one or more second control units 20 are prepared for each tone sequence. When the tone sequence corresponding to a specified or selected tone is specified or selected, the sound source printed circuit board corresponding to the tone sequence is specified or selected, and the sound source (TG) 25 on that printed circuit board reads the waveform data from the waveform memory 26 and sends the data to the DSP 16 of the first control unit 10 as instructed by the CPU 21 on the board.

Figure 2:
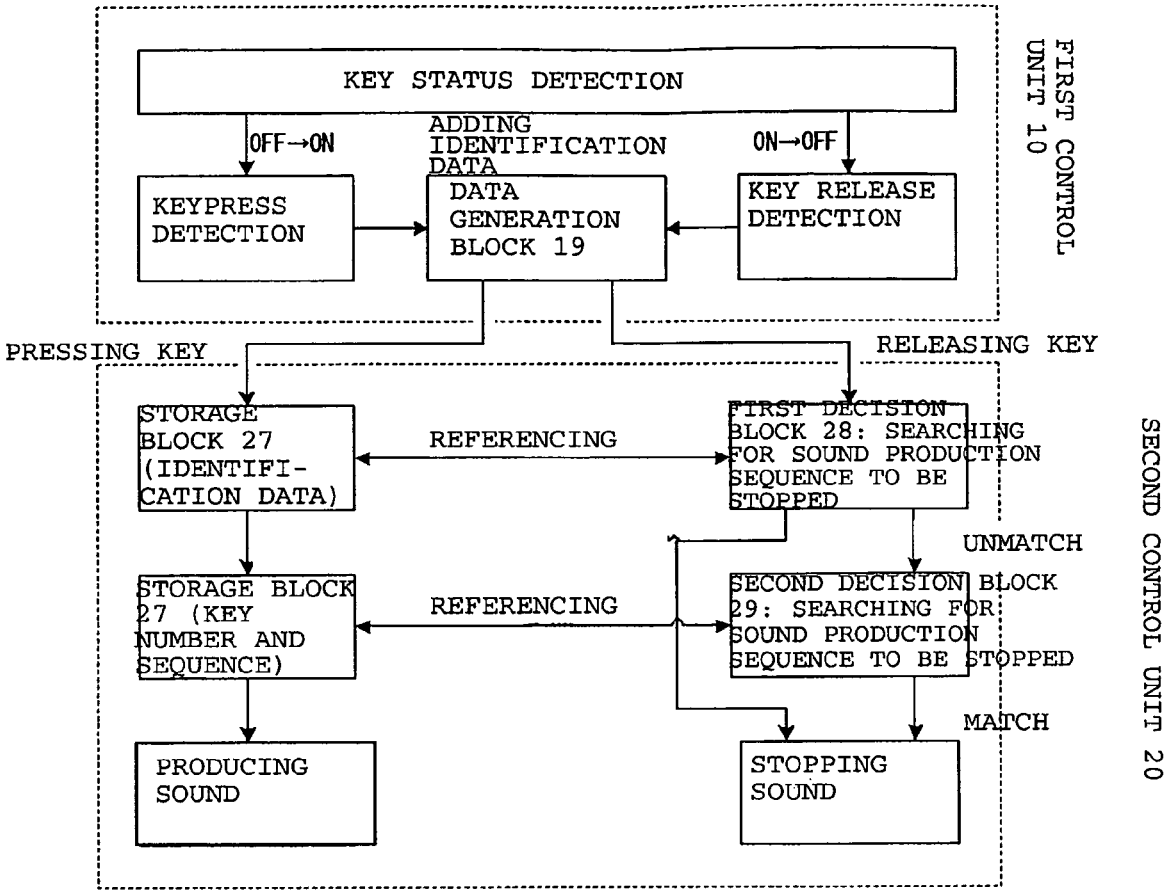
FIG. 2 is a functional block diagram of the electronic musical sound generator according to the embodiment, formed of a first control unit and second control units.

FIG. 2 is a functional block diagram of the electronic musical sound generator according to the present embodiment, formed of the first control unit 10 and the second control unit 20.

As shown in the figure, the electronic musical sound generator includes the first control unit 10, which sends an instruction to start or finish sound production, and the second control unit 20, which starts or finishes the sound production in response to the instruction. The electronic musical sound generator includes a data generation block 19 for adding identification data to the tone sequence, the key number, and the intensity of performance of a sound to be produced or stopped; the storage block 27, formed of an assignment memory for storing the identification data added by the data generation block 19 tougher with the key number and the intensity of performance for each sound production sequence when a key is pressed to cause sound production to be started; a first decision block 28 for comparing the identification data added by the data generation block 19 with the identification data stored in the storage block 27, determining a sound production sequence to be stopped according to the result of comparison, and for sending an instruction to stop the sequence at least when the key is released among events regarded as triggers to finish the sound production; and a second decision block 29 for determining, if a sound production sequence to be stopped cannot be determined from the result of comparison, a sound production sequence to be stopped, according to the sound production sequence being used to produce the sound and the key number, and for sending an instruction to stop the sequence.

Since the structures of the first control unit 10 and the second control unit 20 have been described above, a description thereof is omitted here. "Key status detection", "keypress detection", and "key release detection" shown in the figure are performed by the keyboard described in connection with FIG. 1. These detection results are output from the first control unit 10 to the second control unit 20 as performance data. In addition, performance data sent from a sequencer or another external MIDI unit is also output from the first control unit 10 to the second control unit 20. When a key is pressed or released on the keyboard, the production of the corresponding sound is started or finished. Data input through the external interface at the same time may indicate the same starting point of sound production at the same tone and the same musical interval, in other words, double key pressing may occur in the same track.

The data generation block 19 is formed by causing the CPU 11 to read a corresponding program from the program ROM 12. The data generation block 19 adds identification data to performance data formed of the tone sequence of a sound to be produced or stopped, the key number, and the intensity of performance, the performance data being formed of tone selection information included in a panel operation and performance information related to a key pressing or releasing operation, output from a key scanning circuit (not shown) mounted inside the keyboard.

The storage block 27 is an assignment memory formed in the program RAM 23 provided for each sound source printed circuit board (second control unit 20) in FIG. 1 and stores transmission data transmitted through the internal interface 15 and the internal interface 24, described later with reference to FIG. 7, in the format shown in FIG. 7, the transmission data including identification data (indicated by ID in data (3) in FIG. 7) generated as described above. In other words, when a key is pressed, which starts sound production, the storage block 27 stores identification data added by the data generation block 19 for each sound production sequence, together with the key number and the intensity of performance.

The first decision block 28 is formed by causing the CPU 21 to read a corresponding program from the program ROM 22. At least when the key is released, the first decision block 28 has a function to compare the identification data added by the data generation block 19 with the identification data stored in the storage block 27, to determine a sound production sequence to be stopped according to the result of comparison, and to send an instruction to stop the sequence.

The second decision block 29 is formed by causing the CPU 21 to read a corresponding program from the program ROM 22. When a sound production sequence to be stopped could not be determined as the result of comparison made by the first decision block 28, the second decision block 29 searches data in the storage block 27, determines a sound production sequence to be stopped, according to the sequence being produced and the key number, and sends an instruction to stop the sequence.

The CPU 21 outputs a sound stop instruction by setting the corresponding sound production flag to zero. A sound production flag is specified for each sequence in the program RAM 23.

In the structure described above, as described above, "key status detection" obtained by "keypress detection" or "key release detection" is output from the first control unit 10 to the second control unit 20 as performance data. In addition, performance data sent from a sequencer or another external MIDI unit is also output from the first control unit 10 to the second control unit 20.

The data generation block 19 adds identification data to the tone sequence, the key number, and the intensity of performance of a sound to be produced or stopped, these data items being made from performance information related to a key pressing or releasing operation, and outputs these data items as performance data to the second control unit 20.

The storage block 27 stores the performance data having the identification data, output and transmitted in the format shown in FIG. 7, described later. In other words, when a key is pressed, which starts sound production, the storage block 27 stores the key number and the intensity of performance together with the identification data added by the data generation block 19 for each sound production sequence.

In the same way, the storage block 27 also stores performance data sent from a sequencer or another external MIDI unit for the tone sequence specified in the performance data.

When a key is pressed or released on the keyboard, the production of the corresponding sound is started or finished. Data input through the external interface at the same time may indicate the same starting point of sound production at the same tone and the same musical interval, in other words, double key pressing may occur in the same track.

Therefore, at least when the key is released, the first decision block 28 compares the identification data added by the data generation block 19 with the identification data stored in the storage block 27, determines a sound production sequence to be stopped according to the result of comparison, and sends an instruction to stop the sequence. With this, even if double key pressing occurs in the same track, the production of the musical sound can be stopped by releasing the key.

If noise occurs in a transmission path between the internal interface 15 and the internal interface 24 connecting the first control unit 10 and the second control unit 20 with the result that an erroneous instruction caused by the noise is transmitted, the sound production sequence to be stopped may not be found (it may be impossible to compare the identification data) (in that case, the sound production sequence to be stopped continues to be produced).

In such a case, the second decision block 29 searches data in the storage block 27, determines a sound production sequence to be stopped, according to the sequence being produced and the key number, and sends an instruction to stop the sequence.

Figure 3:
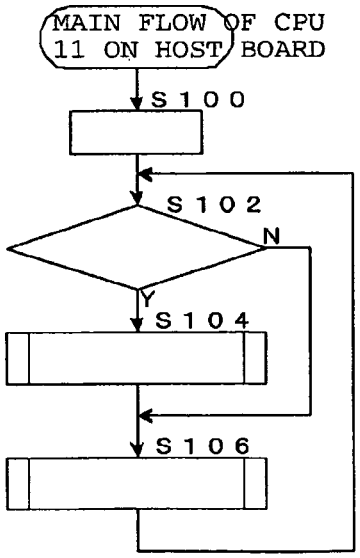
FIG. 3 is a flowchart of a main flow procedure of the CPU in the first control unit.

FIG. 3 is a flowchart of a main flow procedure of the CPU 11 in the first control unit 10.

As shown in the figure, when the switch for the electronic organ is turned on, each component in the first control unit 10, disposed on the host printed circuit board, is initialized, and the key scanning circuit, a pedal scanning circuit, and a panel scanning circuit connected to the first control unit 10 are also initialized (in step S100).

Then, it is determined whether an event has occurred (in step S102). If an event has not occurred (No in step S102), the procedure proceeds to step S106 (time variable process). If an event has occurred (Yes in step S102), the procedure proceeds to an event process (in step S104).

After the event process, the time variable process is executed (in step S106), and then, the procedure returns to step S102.

Figure 4:
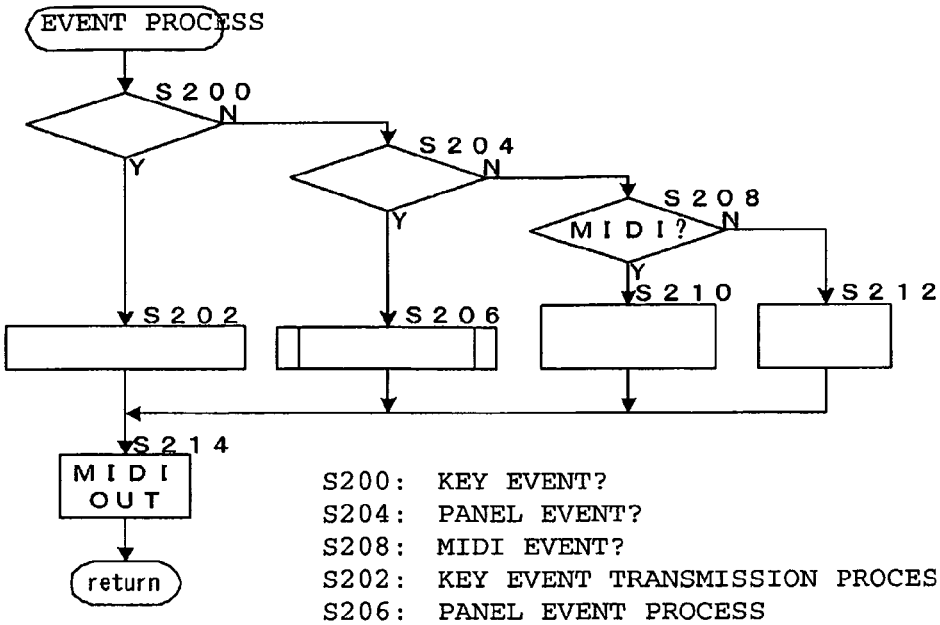
FIG. 4 is a flowchart of a procedure for an event process in step S104 shown in FIG. 3.

FIG. 4 is a flowchart of a procedure for the event process in step S104 shown in FIG. 3.

It is determined whether a key event has occurred in the keyboard (in step S200). If a key event has occurred (Yes in step S200), a key event transmission process is executed (in step S202).

If a key event has not occurred in the keyboard (No in step S200), it is determined whether a panel event has occurred (in step S204). If a panel event has occurred (Yes in step S204), a panel event process is executed (in step S206).

If a panel event has not occurred (No in step S204), it is determined whether a MIDI event has occurred (in step S208). When a MIDI event has occurred (Yes in step S208), a MIDI event process is executed (in step S210).

If a MIDI event has not occurred (No in step S208), a sound source (TG) event process is executed in the second control unit 20 (in step S212).

After the process in step S202, S206, S210, or S212, a MIDI out process is executed (in step S214). In the MIDI out process, an external MIDI unit is used to rewrite the waveform data. Then, the procedure proceeds to the time variable process in step S106.

Figure 5:
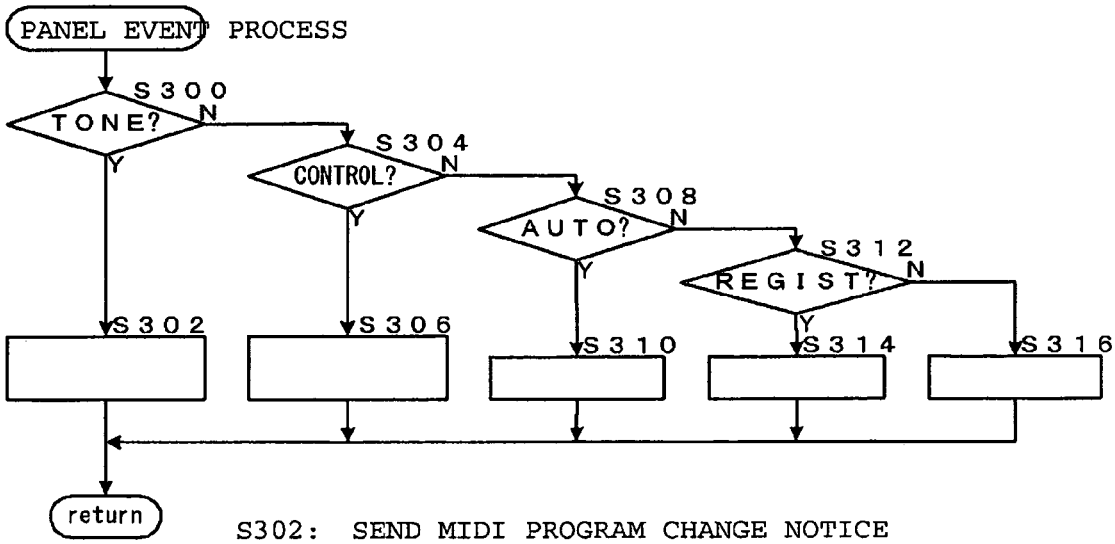
FIG. 5 is a flowchart of a procedure for a panel event process in step S206 shown in FIG. 4.

FIG. 5 is a flowchart of a procedure for the panel event process in step S206 shown in FIG. 4.

As shown in the figure, it is determined in this panel event process whether a tone has been specified or changed (in step S300). If a tone has been specified or changed (Yes in step S300), a MIDI program change notice is sent to the second control unit 20 (in step S302).

If a tone has not been specified or changed (No in step S300), it is determined whether a control change has occurred (in step S304). If a control change has occurred (Yes in step S304), a MIDI control change notice is sent to the second control unit 20 (in step S306).

If a control change has not occurred (No in step S304), it is determined whether an automatic mode has been specified (in step S308). If the automatic mode has been specified (Yes in step S308), an automatic mode setting process is executed (in step S310). With this, the registered automatic mode process is executed in the time variable process, described later.

If the automatic mode has not been specified (No in step S308), it is determined whether a registration process, such as a start or stop process for the sequencer or a start or stop process for an automatic accompaniment, has been specified (in step S312). If the registration process has been specified (Yes in step S312), a registration setting process is executed (in step S314).

If the registration process has not been specified (No in step S312), a menu screen is displayed (in step S316).

After any of the processes described above, the procedure proceeds to the MIDI out process in step S214.

Figure 6:
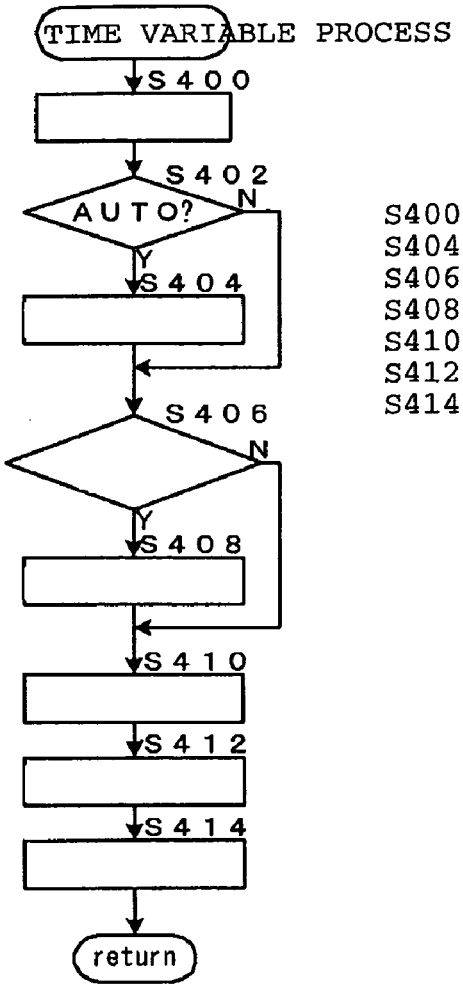
FIG. 6 is a flowchart of a procedure for a time variable process in step S106 shown in FIG. 3.

FIG. 6 is a flowchart of a procedure for the time variable process in step S106 shown in FIG. 3.

The time variable process obtains the elapsed time since the last process and is an interrupt process for the CPU 11 at predetermined intervals.

First, a parameter ΔTi is obtained (in step S400).

Then, it is determined whether the automatic mode has been specified (in step S402). If the automatic mode has not been specified (No in step S402), the procedure jumps to step S406. When the automatic mode has been specified (Yes in step S402), a process for generating an event automatically is executed (in step S404).

Then, it is determined whether registration data for the start or stop process for the sequencer or the start or stop process for an automatic accompaniment is being transmitted (in step S406). If the registration data is not being transmitted (No in step S406), the procedure proceeds to step S410.

If the registration data is being transmitted (Yes in step S406), a process for sending the next block (sequence data) is executed (in step S408).

Then, an expression pedal process detected in an event detection process is executed (in step s410), and a panel scanning process (in step S412) and a key scanning process (in step S414) are executed.

FIG. 7 shows the format and contents of data exchanged between the internal interface 15 and the internal interface 24. The data is finally stored in the storage block 27 serving as an assignment memory.

Core data among the stored data is five-byte data shown in FIG. 7: an event number indicating the order of an event (see upper and intermediate rows in the figure), a tone sequence to be produced or stopped (track number), a key number (data (1)), the intensity of performance (data (2)), and identification data added by the data generation block 19 (data (3)). The track number at the second byte indicates a sound production sequence related in meaning to each tone sequence, the meaning being shown at a lower row in the figure. For example, two sound production sequences having track numbers 0x00 and 0x01 correspond to an identical upper orchestra tone; and three sound production sequences having track numbers 0x04, 0x05, and 0x06 correspond to an identical upper solo tone.

FIG. 8 is a flowchart of a main flow procedure of the CPU 21 in the second control unit 20 (sound source printed circuit board).

As shown in the figure, when the switch for the electronic organ is turned on, each component in the second control unit 20, disposed on the sound source printed circuit board, is initialized (in step S500), in the same way as in FIG. 3.

Then, it is determined whether an event (my event) has occurred in the sequence specified by the track number for each sound source printed circuit board (for each track number shown in FIG. 7) (in step S502). If my event has not occurred (No in step S502), the procedure jumps to step S506 (time variable process). When my event has occurred (Yes in step S502), the procedure proceeds to an event process (in step S504).

After the event process, the time variable process is executed (in step S506), and then, the procedure returns to step S502.

Figure 9:
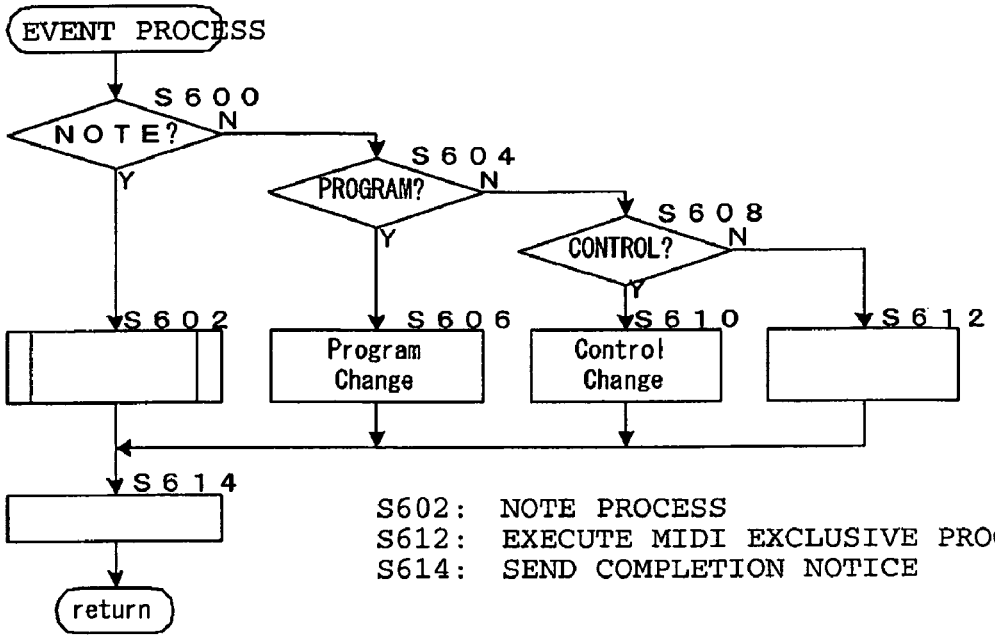
FIG. 9 is a flowchart of a procedure for an event process in step S504 shown in FIG. 8.

FIG. 9 is a flowchart of a procedure for the event process in step S504 shown in FIG. 8.

It is determined whether a key event has occurred in the keyboard (in step S600). When a key event has occurred (Yes in step S600), a note process, described later, related to key pressing or key releasing is executed (in step S602).

If a key event has not occurred in the keyboard (No in step S600), it is determined whether a program change event for switching the tone or effect has occurred (in step S604). If a program change event has occurred (Yes in step S604), a program change process is executed (in step S606).

If a program change event has not occurred (No in step S604), it is determined whether a control change event for adjusting the level of each effect has occurred (in step S608). If a control change event has occurred (Yes in step S608), a control change process is executed (in step S610).

If a control change event has not occurred (No in step S608), a MIDI exclusive process is executed (in step S612).

After the process in step S602, S606, S610, or S612, a completion notice indicating that all processes have been completed in the sound source printed circuit board (sound production sequence) is sent (in step S614). Then, the procedure returns to the time variable process in step S506.

Figure 10:
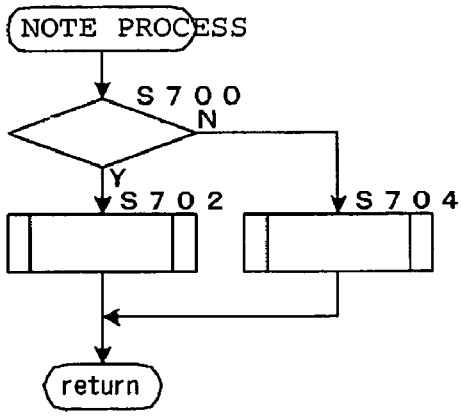
FIG. 10 is a flowchart of a procedure for a note process in step S602 shown in FIG. 9.

FIG. 10 is a flowchart of a procedure for the note process in step S602 shown in FIG. 9.

It is determined first whether a key has been pressed (in step S700). If a key has been pressed (Yes in step S700), a key pressing process is executed (in step S702). If a key has not been pressed (No in step S700), a key releasing process is executed (in step S704). Then, the procedure proceeds to the completion notice transmission process in step S614.

Figure 11:
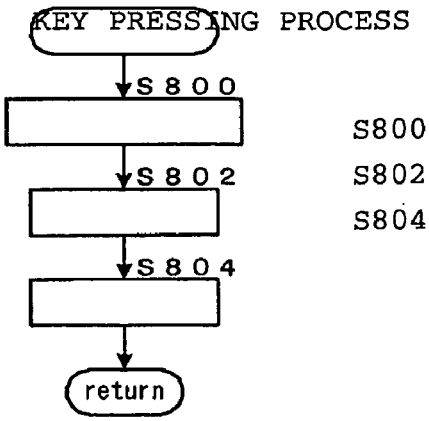
FIG. 11 is a flowchart of a procedure for a key pressing process in step S702 shown in FIG. 10.

FIG. 11 is a flowchart of a procedure for the key pressing process in step S702 shown in FIG. 10.

Since a key has been pressed, a key map updating process is executed for each track (in step S800). The key map updating process updates the preceding key map stored in the storage block 27 according to the result of comparing generated data related to the new key pressing with deleted data related to key releasing. The key map will be described later with reference to FIG. 13.

When a new sound production sequence is required due to the key map updating, a key assignment process (for determining a sound production sequence to produce a new sound and for sending data to the assignment memory) is executed (in step S802). Then, a sound production process is executed (in step S804). In the sound production process, the CPU 21 reads data for each sound production sequence, as shown in FIG. 7, from the storage block 27, the sound source (TG) 25 reads necessary waveform data, the DSP 16 in the first control unit 10 adds an effect, the DAC 17 converts the signal to an analog signal, the amplifier and equalizer 18 performs amplification, and the sound is produced (in step S804).

Figure 12:
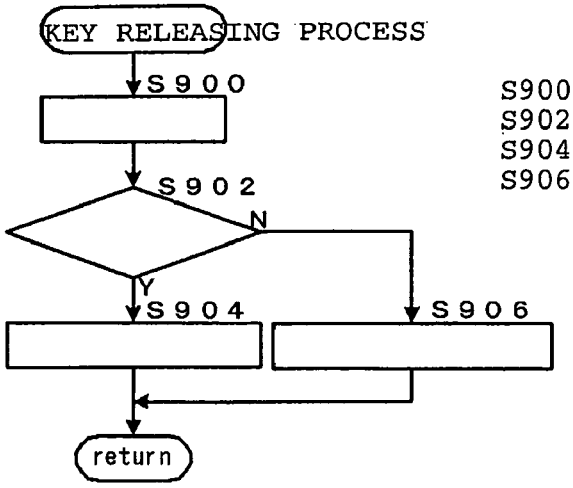
FIG. 12 is a flowchart of a procedure for a key releasing process in step S704 shown in FIG. 10.

FIG. 12 is a flowchart of a procedure for the key releasing process in step S704 shown in FIG. 10.

In the key releasing process, data (key map) stored in the storage block 27 is referenced (in step S900), and the first decision block 28 compares the identification data (data (3) in FIG. 7) added by the data generation block 19 when the key was released with the data stored before in the storage block 27 to determine whether the same identification data has been stored (in step S902).

If the same identification data has been stored (Yes in step S902), the key corresponding to the identification data is regarded as the key released (in step S904), the sound production sequence to be stopped is determined, and then the sound production is stopped. Therefore, even if data input through the external interface at the same time indicates the same starting point of sound production at the same tone and the same musical interval, in other words, if double key pressing occurs in the same track, the production of the musical sound can be stopped due to the release of the key.

If noise occurs in a transmission path between the internal interface 15 and the internal interface 24, connecting the first control unit 10 and the second control unit 20 with the result that an erroneous instruction caused by the noise is transmitted to prevent the identification data from being compared (No in step S902), in other words, if a sound production sequence to be stopped cannot be found, the second decision block 29 searches the data in the storage block 27, regards a key having identification data different from the one sent as the released key, according to the sequence being produced and the key number (in step S906), determines a sound production sequence to be stopped, and then stops the sound production. Therefore, even if the sound production sequence, which should be stopped, continues to be produced since the sound production sequence to be stopped cannot be found because of transmission of an erroneous instruction, the production of the musical sound can be stopped due to the release of the key because the second decision block 29 searches the data in the storage block 27 and determines the sound production sequence to be stopped, according to the sequence being produced and the key number.

Figure 13:
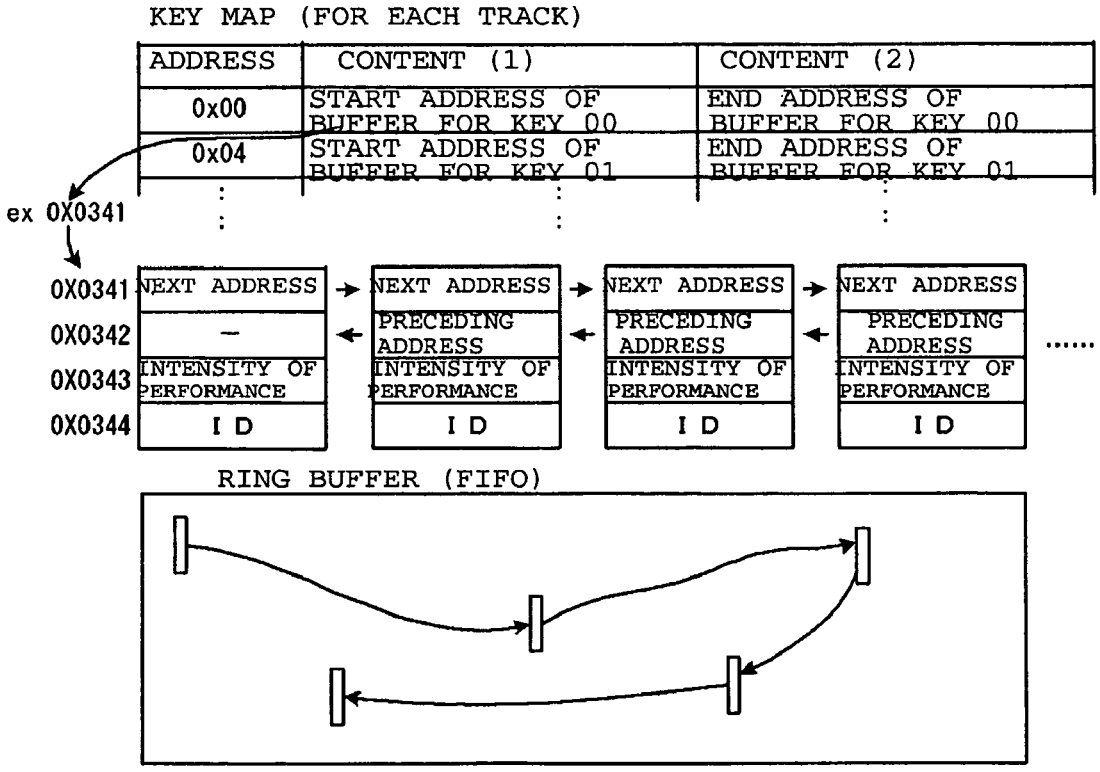
FIG. 13 shows the status of a key map for each track (each sound production sequence), and the stored address status and the stored data status of the assignment memory of the track.

FIG. 13 shows the status of a key map for each track (each sound production sequence), and the stored address status and the stored data status of the assignment memory of the track.

As shown at an upper part of FIG. 13, the start address and the end address of the buffer for each key are stored as index address data at the address assigned to the key for each track. For example, the start address and the end address of the buffer for a key 00 are stored at an address 0x00 for the key 00; and the start address and the end address of the buffer for a key 01 are stored at an address 0x04 for the key 01.

Assuming that the key 00 is specified as the key number in data having the format shown in FIG. 7, if the start address of the buffer for the key 00 is 0x0341, the address of the area to be read next in the buffer, the address of the area read precedingly in the buffer, the intensity of performance when the sound is produced, which was given to the key specified by the key number in the data having the format shown in FIG. 7, and the identification data given in the same way in the data are stored at 0x0341 to 0x0344 in the buffer, as indicated at the middle part of FIG. 13. Therefore, for keys having no key numbers (for example, key 00 to key 87) in the data having the format shown in FIG. 7, buffer addresses are not written in the corresponding contents (1) and (2) at the upper part of FIG. 13.

At the start address of the buffer, the address of the area to be read next in the buffer is written in the first byte. In the next byte, the address of the area read precedingly in the buffer is written. As shown at the lower part of FIG. 13, such a data storage form is a typical FIFO memory form.

In the electronic organ having the electronic musical sound generator according to the present embodiment, described above in detail, the stored data (key map) in the storage block 27 is referenced; the first decision block 28 compares the identification data (data (3) in FIG. 7) added by the data generation block 19 when the key was released with the data stored before in the storage block 27; and if the same identification data has been stored, the key corresponding to the same identification data is regarded as the released key. Then, the sound production sequence to be stopped is determined, and the sound production is stopped. Therefore, even if data input through the external interface at the same time indicates the same starting point of sound production at the same tone and the same musical interval, in other words, if double key pressing occurs in the same track, the production of the musical sound can be stopped due to the release of the key.

Even if noise occurs in a transmission path between the internal interface 15 and the internal interface 24, connecting the first control unit 10 and the second control unit 20, with the result that an erroneous instruction caused by the noise is transmitted to prevent the identification data from being compared, in other words, even if the sound production sequence to be stopped cannot be found, the second decision block 29 searches the data in the storage block 27, and regards a key having identification data different from the one sent as the released key, according to the sequence being produced and the key number. Then, the sound production sequence to be stopped is determined, and the sound production is stopped. Therefore, even if an erroneous instruction is sent and the sound production sequence to be stopped cannot be found with the result that the sound production sequence which should be stopped continues being produced, the production of the musical sound can be stopped due to the release of the key because the second decision block 29 searches the data in the storage block 27 and determines the sound production sequence to be stopped, according to the data of the sequence being produced and the key number.

An electronic musical sound generator according to the present invention is not limited to the above-described embodiment shown in the figures. Various modifications can be made within the scope of the present invention.

An electronic musical sound generator according to the present invention can be applied to electronic musical instruments, and in addition, to sound source boards used for personal computers and games.

The entire disclosure of Japanese Patent Application No. 2008-056168, filed on Mar. 6, 2008, including the specification, claims, drawings and summary, is incorporated herein by reference in its entirety.

What is claimed is:

1. An electronic musical sound generator comprising:

first control means for sending an instruction to start or finish producing a sound;

second control means for starting or finishing producing the sound in response to the instruction;

data generation means for adding identification data to a tone sequence, a key number, and the intensity of performance of a sound to be produced or stopped;

storage means for storing, when a key is pressed to cause sound production to be started, the identification data added by the data generation means for each sound production sequence together with the key number and the intensity of performance;

first decision means for comparing the identification data added by the data generation means with the identification data stored in the storage means, for determining a sound production sequence to be stopped, according to a result of comparison, and for sending an instruction to stop the sequence, at least when the key is released among events regarded as triggers to finish the sound production; and second decision means for determining, if a sound production sequence to be stopped cannot be determined as the result of comparison, a sound production sequence to be stopped, according to the sequence being produced and the key number, and for sending an instruction to stop the sequence.

2. The electronic musical sound generator according to claim 1, wherein storage means comprises an assignment memory usually provided for each sound production sequence.

* * * * *